United States Patent [19]

Craig

[11] 4,306,431

[45] Dec. 22, 1981

[54] CHEST SAFETY LOCK

[75] Inventor: Clark E. Craig, Rockford, Ill.

[73] Assignee: Keystone Consolidated Industries, Inc., Peoria, Ill.

[21] Appl. No.: 98,134

[22] Filed: Nov. 28, 1979

[51] Int. Cl.[3] ..... E05B 65/44

[52] U.S. Cl. ..... 70/79; 70/162; 292/341.17; 292/DIG. 37; 292/DIG. 65

[58] Field of Search ..... 70/79, 80, 162, 70; 292/99, 303, 304, 341.17, 246, DIG. 37, DIG. 65

[56] References Cited

U.S. PATENT DOCUMENTS

| | | | |
|---|---|---|---|
| 1,918,979 | 7/1933 | North | 70/80 |
| 2,399,812 | 5/1946 | Ledin | 292/DIG. 37 X |
| 3,677,042 | 7/1972 | Atkinson | 70/70 |

FOREIGN PATENT DOCUMENTS

| | | | |
|---|---|---|---|
| 489564 | 7/1938 | United Kingdom | 70/80 |

*Primary Examiner*—William E. Lyddane

*Attorney, Agent, or Firm*—Allegretti, Newitt, Witcoff & McAndrews

[57] ABSTRACT

A cedar chest lock remains unlocked unless positive actuation of a strike engaging member is effected. The lock includes a strike member projecting from the chest lid for cooperation with a locking latch plate retained in a housing mounted in the side wall of the chest. The housing thus has an opening for receipt of the strike member. A latch plate is pivotally mounted in the housing and is spring biased to a position which avoids engagement with the strike member upon insertion of the strike member through the housing opening. A push button in the housing may be actuated to engage and position the latch plate for cooperation with the strike member. Actuating the push button and subsequent positioning of the strike member through the opening in the latch housing permits the latch plate to engage the strike member thereby locking the chest lid in a closed position. The push button may include a key operated lock.

6 Claims, 10 Drawing Figures

Fig. 1
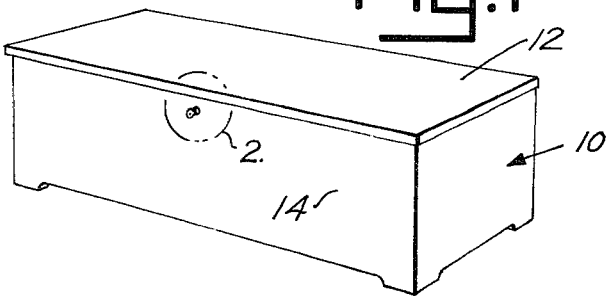
Fig. 2
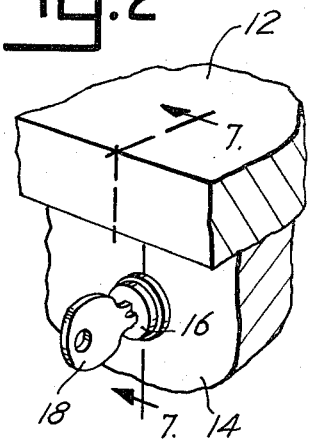
Fig. 4
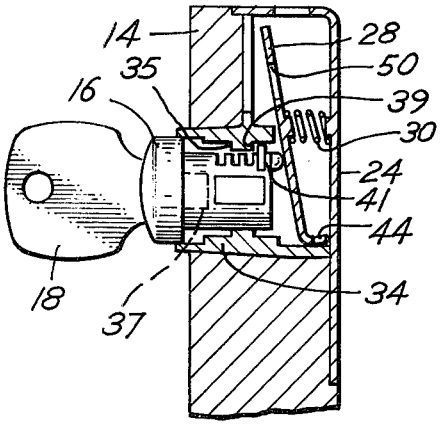
Fig. 5
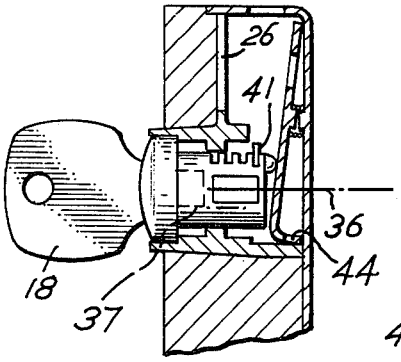
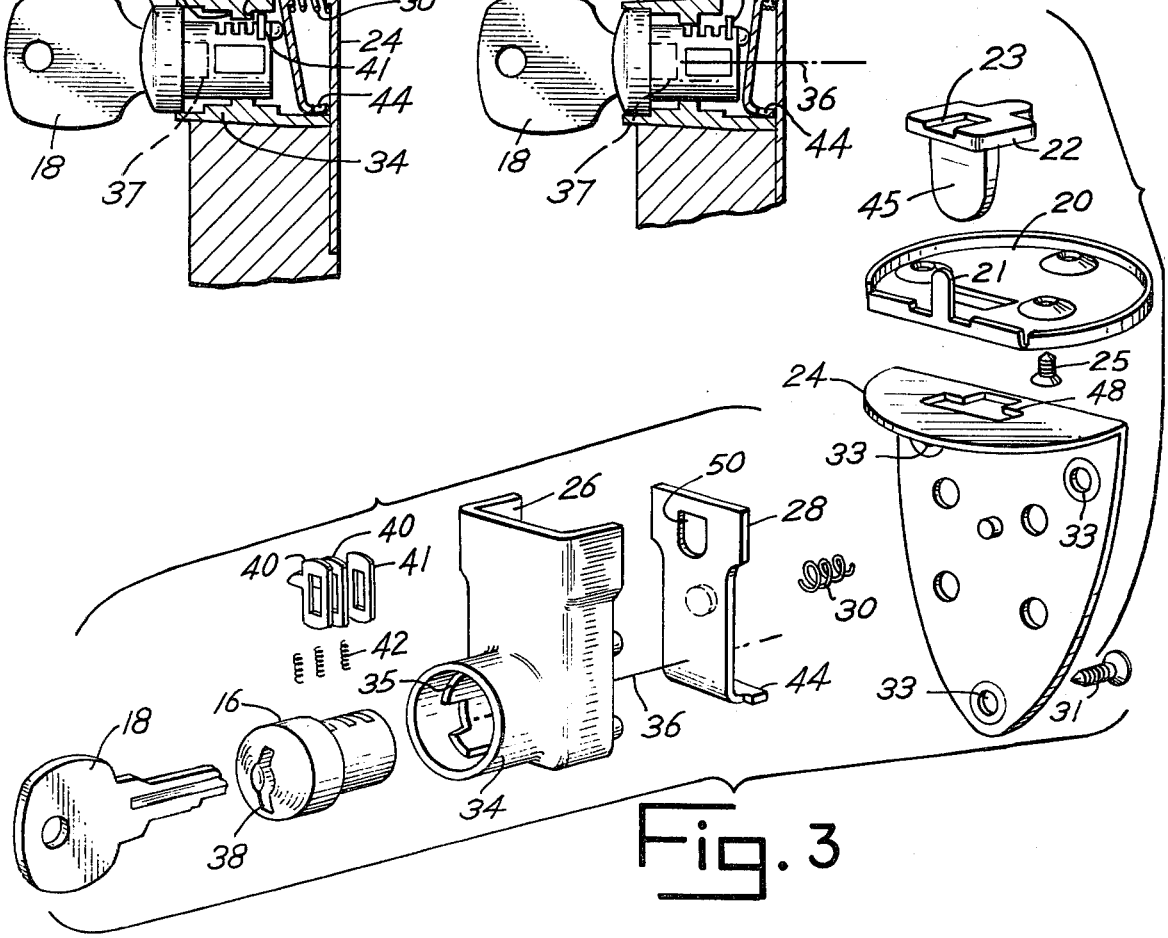
Fig. 3

CHEST SAFETY LOCK

BACKGROUND OF THE INVENTION

This invention relates to an improved lock construction and more particularly to a lock which may be incorporated with a chest or the like to provide a safety locking feature.

The use of a chest for storage of clothing and other materials is quite common. Typically, the chest will include a lock or latch so that the contents, such as blankets or the like, may be securely stored within the chest. A problem may result, however, in the event that a small child enters the chest and lowers the lid. The latch mechanism may catch thereby preventing egress from the chest.

To overcome this potential problem, the chest may include a handle or key operated catch. To open the lid of the chest, the catch is disengaged and maintained in a disengaged position from the strike member. Various prior art patents disclose this and similar types of latches and locks utilized for chests and similar enclosures:

| Reg. No. | Inventor | Title | Issue Date |
|---|---|---|---|
| 1,094,773 | Beehler | Box Lock or Fastener | 4/28/14 |
| 1,759,401 | Hogan | Lock | 5/20/30 |
| 1,830,281 | Loftin | Aroma Tight Lock | 11/03/31 |
| 1,918,979 | North | Lock | 7/18/33 |
| 2,161,519 | Loftin et al | Lock | 6/06/39 |
| 3,339,956 | Bencene et al | Cabinet Cover Latch | 9/05/67 |
| 3,743,335 | Reilhac et al | Lock with a Staple-Type Bolt | 7/03/73 |

In general, these prior art patents disclose a spring biased latch member which cooperates with a strike member. The latch member is generally operated by a push button or some other actuating device to release the latch.

The present invention contemplates utilization of a similar latch mechanism with the additional feature that the latch mechanism will engage the strike member only if the push button actuator is operated prior to positioning of the strike member within the latch housing. In this manner, the safety features of a catch are combined with the appearance and operating characteristics of a spring latch.

SUMMARY OF THE INVENTION

Briefly, the present invention comprises an improved lock or latch construction particularly useful with a chest such as a cedar chest. The lock includes a latch housing of special construction adapted for cooperation with a strike member. An opening in the latch housing is provided for receipt of the strike member. A pivotal latch plate within the housing is positioned for cooperative engagement with the strike member. The latch plate engages the strike member only when properly actuated in a specific sequence by means of a mechanical actuator. Otherwise, the latch plate remains in an inoperative position and will not engage the strike member. Consequently, the lid of the chest will remain unlatched even when closed.

It is thus an object of the present invention to provide an improved safety latch construction for use with a chest such as a cedar chest.

It is a further object of the present invention to provide an improved latch construction which is operated by means of a manual push button to effect latch engagement and disengagement.

Still another object of the present invention is to provide an improved latch mechanism having a safety feature which has a simple and economical construction.

One further object of the present invention is to provide an improved latch construction which is adaptable to be key operated.

These and other objects, advantages and features of the present invention will be set forth in the detailed description which follows.

BRIEF DESCRIPTION OF THE DRAWING

In the detailed description which follows, reference will be made to the drawing comprised of the following figures:

FIG. 1 is a perspective view of a typical chest which incorporates the improved lock of the present invention;

FIG. 2 is an enlarged perspective view of the lock for the chest of FIG. 1;

FIG. 3 is an exploded perspective view of the improved lock configuration of the present invention; and FIGS. 4–10 are sequential side cross sectional views of the lock of the invention wherein FIG. 7 is taken along the line 7—7 in FIG. 2.

DESCRIPTION OF THE PREFERRED EMBODIMENT

Figure 6:
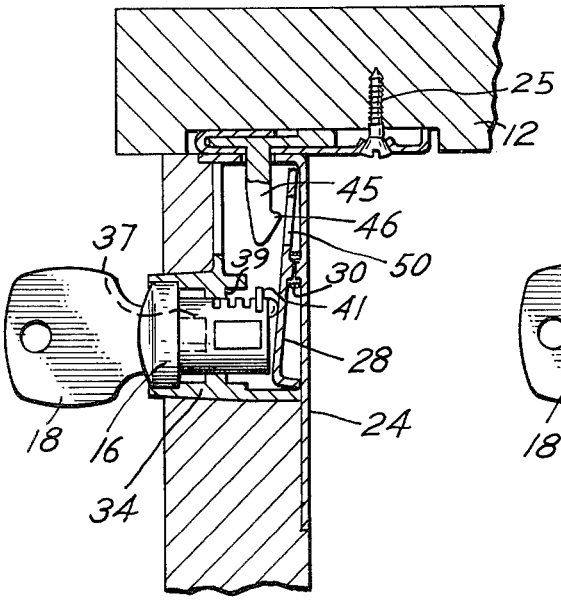
Figure 7:
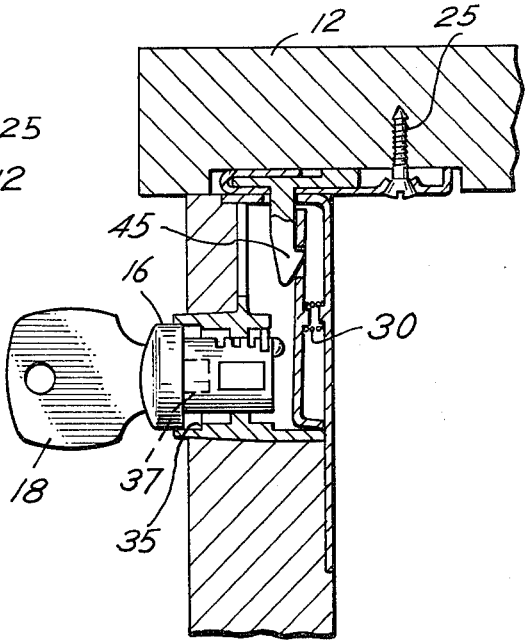

As shown in FIG. 1, a chest 10 typically includes a chest lid 12 hinged at one edge to a chest wall. The lid 12 generally includes a strike member 13 (as depicted in FIGS. 3 and 6–10) which cooperates with a latch assembly 15 (as depicted in FIGS. 3–10). Assembly 15 is mounted in the front wall 14 of the chest 10. As shown in FIG. 2, the latch assembly 15 is operated by a push button actuator 16. A key 18 is cooperative with the actuator 16 to lock and unlock the lock.

Referring to FIGS. 3–10, the improved lock of the present invention includes a strike member 13 comprised of a strike plate 20 and a strike head 22. The head 22 may be of a zinc die cast material and is retained on the lid 12 by the plate 20. A tab 21 of plate 20 folds into groove 23 of head 22 to retain head 22. The plate 20 is attached to the lid 12 by screws 25. The strike member 13 is positioned for cooperation with the housing assembly 15.

Housing assembly 15 is comprised of a mounting plate 24, push button housing 26, latch plate 28 and push button or cylinder 16. The latch plate 28 is pivotally mounted within the housing 26. A spring 30 is interposed between plates 24 and 28. Push button 16 is slidably mounted within barrel 34 defined by housing 26 and is movable longitudinally in the direction of barrel axis 36. The latch assembly 15 is retained in chest wall 14 by fasteners 33 which fit through openings 31 in plate 24.

Key 18 may be inserted through keyhole 38 to actuate tumblers 40 biased by springs 42. The end tumbler 41 retains the push button or cylinder 16 within barrel 34 and limits the outward movement of the cylinder 16. That is, as shown in FIGS. 4–10, the tumbler 41 rides against shoulder 39 of barrel 34 to limit outward movement of cylinder 16. Inward movement of cylinder 16 is limited by engagement of a lug 37 on cylinder 16 with a shoulder 35 is barrel 34. Consequently, the cylinder 16 has inward and outward limits of movement in the direction of axis 36.

Figure 10:
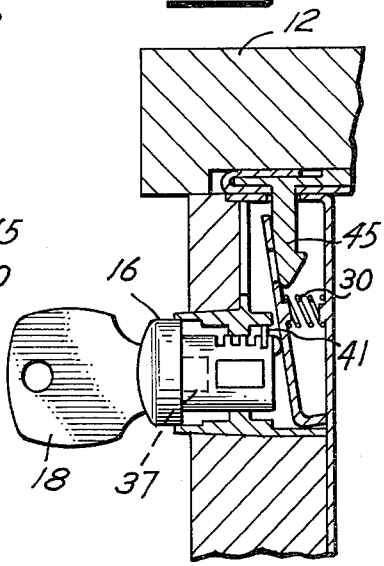

The latch plate 28 is an L-shaped plate having a lower tab 44 which rests against base 46 of housing 26. When the cylinder 16 is not locked, spring 30 normally biases plate 28 to the position illustrated in FIG. 4 and simultaneously maintains the push button 16 in a projected position. When the plate 28 is in the position shown in FIG. 4, the strike head 22, which includes a depending tongue 45 with a laterally projecting lug 46, may fit through an opening 48 in latch mounting plate 24. The lug 46 will, however, not be engaged with an opening 50 of latch plate 28. This is shown in FIG. 10. As a consequence, the lid 12 is not latched. The lid may, therefore, be lifted from the chest 10.

Figure 8:
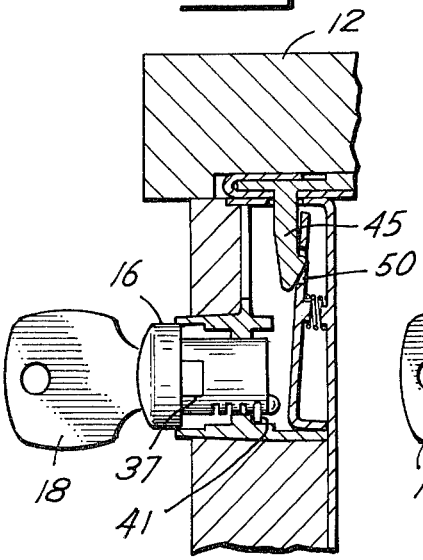
Figure 9:
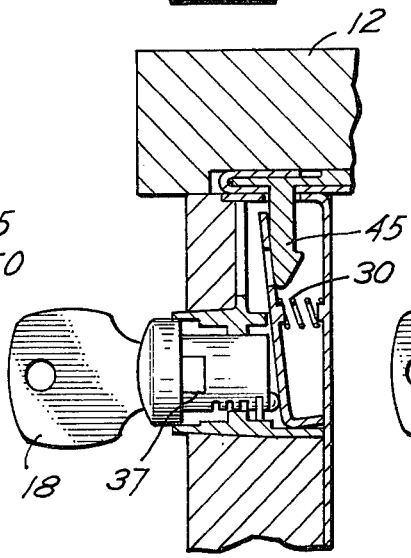

To effect latching, the unlocked push button 16 is depressed prior to lowering of the lid 12 as shown in FIG. 5. In this manner the plate 28 is manually biased to the right as shown in FIGS. 5 and 6. Lug 46 is thereby positioned opposite opening 50 of plate 28. The lid 12 may be raised or lowered when button 16 is depressed. When lowered, the lug 46 is in opposed relation to the opening 50. The push button 38 may then be released so that the opening 50 is engaged by the lug 46 as shown in FIGS. 8 and 9. In this manner the lid 12 is effectively retained in position with respect to the side wall 14 of the chest 10 until the push button 16 is once again depressed to pivot the plate 28 and permit release of lug 46 and lid 12. Of course, the key 18 may be operated to lock the push button or cylinder 16 in the position of FIG. 9. Typically, as shown in FIG. 9, the push button 26 is rotated 180° so that the lug 37 tightly engages shoulder 35 and prevents depressing of button 16. The lid 12 is then locked in a closed position. Reversing the sequence permits depression of the button 16 and opening of lid 12.

As can be seen, the latch of the present invention provides an improved safety lock feature whereby positive positioning of the latch member 28 is required in order to effect lock action. Various changes may be made to the structure of the invention without departing from the spirit of the invention. The invention is, therefore, to be limited only by the following claims and their equivalents.

What is claimed is:

1. An improved latch assembly which includes a safety catch feature, comprising, in combination:

a housing having a base side, a top opening opposed to the base side and positioned for receipt of a separate strike member, and a side opening for a pushbutton;

a strike member including a latch tongue for projecting into the latch housing top opening, said tongue including a lug aligned to project away from the side opening in the housing when the strike tongue is inserted into the housing;

a latch plate pivotally mounted in the housing and extending from the base side toward the top opening, said plate including a lug receiving opening adjacent the top opening, said plate pivotal about an axis permitting movement of the plate lug receiving opening between opposite sides of the housing past the top opening;

biasing means in the housing for pivoting the plate toward the side of the housing having the pushbutton opening and out of position for the strike to engage the plate upon insertion into the strike opening;

a push button mounted in the housing side opening for movement generally transverse to the plate and for engaging the biased latch plate and pivoting said latch plate against the biasing force to position the plate on the opposite side of the housing aligned for engagement of the lug receiving opening with the lug of the strike member upon release of the push button means.

2. The assembly of claim 1 wherein said push button includes a lock for locking the push button to prevent travel in the transverse direction with respect to the latch plate.

3. The assembly of claim 1 wherein said latch plate is biased by a coil spring interposed between the plate and housing.

4. The assembly of claim 1 wherein said pushbutton includes a key actuated lock rotatable about the transverse axis between locked and unlocked positions.

5. The assembly of claim 1 wherein said latch plate is planar and pivots about a bottom edge.

6. An improved latch assembly which includes a safety catch feature comprising, in combination:

a housing having a base side, a top opening opposed to the base side, and positioned for receipt of a separate strike member, and a side opening for a pushbutton;

a strike member including a latch tongue for positioning in the latch housing top opening;

a latch plate pivotally mounted in the housing and extending from the base side toward the top opening, said plate pivotal about an axis permitting movement of the plate between opposite sides of the top opening of the housing;

biasing means in the housing for driving the plate toward the side of the housing having the pushbutton opening and out of position for the strike to engage the plate upon insertion of the strike into the top opening;

a pushbutton mounted in the housing side opening for movement generally transverse to the plate and for engaging the biased latch plate and pivoting said latch plate against the biasing force to position the plate on the opposite side of the housing, one of said plate and said strike latch tongue including an opening and the other including a transverse lug cooperative to engage the strike member and plate when the force on the pushbutton is released permitting the plate to move away from the opposite side of the housing and engage the strike member only when the strike member inserted into the top opening after the pushbutton is actuated to pivot the plate to the appropriate side of the housing.

* * * * *